US005655773A

United States Patent [19]

Marks

[11] Patent Number: 5,655,773

[45] Date of Patent: Aug. 12, 1997

[54] COMBINATION TIC-TAC-TOE GAME AND NUMBERED CARD COMPETITION

[75] Inventor: Howard M. Marks, Westport, Conn.

[73] Assignee: PTT, LLC, Westport, Conn.

[21] Appl. No.: 706,388

[22] Filed: Aug. 30, 1996

Related U.S. Application Data

[62] Division of Ser. No. 595,133, Feb. 1, 1996, Pat. No. 5,580,059.

[51] Int. Cl.[6] ..... A63F 3/00

[52] U.S. Cl. ..... 273/271; 273/264

[58] Field of Search ..... 273/242, 243, 273/264, 271, 292, 305

[56] References Cited

U.S. PATENT DOCUMENTS

| | | | |
|---|---|---|---|
| 1,558,690 | 10/1925 | McCollom . | |
| 1,564,746 | 12/1925 | Barnard . | |
| 1,871,247 | 8/1932 | Trost . | |
| 3,441,280 | 4/1969 | Eggermont . | |
| 3,770,273 | 11/1973 | Reiner . | |
| 3,889,953 | 6/1975 | Grasham . | |
| 3,953,032 | 4/1976 | Moore et al. | 273/271 |
| 4,141,561 | 2/1979 | Spitzner . | |
| 4,213,616 | 7/1980 | Dickey | 273/271 |
| 4,275,442 | 6/1981 | Underwood et al. . | |
| 4,302,015 | 11/1981 | Bowser et al. . | |
| 4,684,136 | 8/1987 | Turner . | |
| 4,813,681 | 3/1989 | Volpert, Jr. . | |
| 5,029,871 | 7/1991 | Willson, Jr. et al. . | |
| 5,248,149 | 9/1993 | Tarrats . | |
| 5,318,307 | 6/1994 | Bouchard et al. . | |
| 5,332,229 | 7/1994 | Fielder et al. . | |
| 5,377,992 | 1/1995 | Audet . | |

FOREIGN PATENT DOCUMENTS

| | | | |
|---|---|---|---|
| 1244174 | 8/1971 | United Kingdom | 273/271 |
| 2113103 | 8/1983 | United Kingdom | 273/271 |

*Primary Examiner*—William E. Stoll

*Attorney, Agent, or Firm*—Lowe, Price, LeBlanc & Becker

[57] ABSTRACT

A game device includes a game board divided into a plurality of zones arranged in a plurality of columns and a plurality of rows and forming a plurality of diagonals. The game device also includes first and second sets of playing pieces respectively used by first and second players. At least three of the first and second sets of the playing pieces are placed into at least three of the plurality of zones of the game board until at least three of the first playing pieces or at least three of the second playing pieces have been placed in one of the plurality of rows, one of the plurality of columns or one of the plurality of diagonals. The game device also includes first and second sets of cards, respectively distributed to the first and second players. Each of the first and second cards having respective first and second rankings associated therewith. To determine which playing piece is to be placed in one of the zones of the game board, the rankings of the first and second cards are compared to each other. The game device can be used in ordinary play, tournament play or choulette play. In addition, the game device includes the features of doubling, bluffing and variations.

12 Claims, 7 Drawing Sheets

COMBINATION TIC-TAC-TOE GAME AND NUMBERED CARD COMPETITION

This is a division of Ser. No. 08/595,133 filed Feb. 1, 1996, now U.S. Pat. No. 5,580,059.

TECHNICAL FIELD

The present invention relates generally to games, and more particularly, a game apparatus for playing tic-tac-toe games.

BACKGROUND ART

Over the years, there have been many different types of games. These have ranged the gamut from those involving great mental prowess to games involving merely chance. Nevertheless, there is still a strong interest in game concepts that create real excitement.

More specifically, with many games the players are placed in the position of passive observers. This is actually most true of the most expensive games that employ electronic components and the like which may or may not involve any skill on the part of the player. Still further, the game development is almost always viewed as unrealistic at best.

Because of this fact, such expensive games are often difficult to market and discarded after minimal play even when purchased by the consumer. Moreover, even when use continues, such games have consistently lacked any relationship to the excitement as well as the strategy and planning that should be the characteristic of any game. While it is generally recognized that decision making in game play is of paramount importance, there has yet to be a game that places players in a realistic decision making capacity.

One game of continued interest over the years is tic-tac-toe. As a result, while the game of tic-tac-toe is interesting, players oftentimes have become bored with continued play thereof.

There have been a number of electrical and mechanical versions of the game of tic-tac-toe designed for either solitary play or play between two players. In addition, electronic tic-tac-toe games are also known which allow a player to compete against a computer programmed to play tic-tac-toe. Such electronic tic-tac-toe games are also available in hand held units utilizing an integrated circuit device known as a microprocessor as the computer.

Everyone is familiar with tic-tac-toe. The game is played between two players who alternately select "X's" or "O's" to be placed in one of the nine boxes formed by two parallel lines intersecting at right angles with two other parallel lines intersecting at right angles with two other parallel lines. The first player begins play by placing an "X" in one of the nine boxes, and the second player places an "O" in another one of the nine boxes. The players continue to alternately place "X's" or "O's" in the array of nine boxes and one of the players may win by placing three of his symbols in one of the three vertical columns, one of the three horizontal rows, or along one of the two diagonals. The game may also end in a draw if neither one of the two players is able to win in the manner described above.

The main advantages of tic-tac-toe are that it is easy to learn, fun, and can be played virtually anywhere. However, it also has a disadvantage that it has limited variations. In fact, if both players are familiar with the game, it is common to continually reach a draw. Because of this interest in tic-tac-toe, there have been many attempts to make the game more interesting and exciting, thereby reducing the inherent disadvantages of the game.

For example, U.S. Pat. No. 4,813,681 illustrates a game 10 including a plurality of playing markers 12 adapted to be arranged in rows 14 and columns 16 (FIG. 1). The playing markers include four playing markers having a first indicia thereon, four playing markers having a second indicia thereon, and a single playing marker having both a first and a second indicia thereon. The playing markers are adapted for random distribution in equal numbers to a pair of players with the remaining playing markers defining a starting point on space 24 in placement area 22. A player places a playing marker in non-diagonal adjacent relation to a previously placed playing marker with the playing markers being placed in turn by the players in like fashion to form the rows and columns. With this arrangement, the rows and columns are each limited to a total of three playing markers arranged in a generally rectangular array. The game winner is the player to be the first with a corresponding first or second indicia on the playing markers disposed in a row, a column or diagonally.

U.S. Pat. No. 4,684,136 describes a game apparatus **10*a* consisting of nine tic-tac-toe arrangements 12*a* (FIG. 2). Two teams answer questions 32*a* until three tic-tac-toe arrangements are won in a vertical, horizontal or diagonal row to completely win the game. Each playing piece 16*a* is placed into aperture 18*a* on playing board 12*a* when question 32*a*** is answered correctly.

U.S. Pat. No. 4,275,442 describes an electronic tic-tac-toe game **10*b* that includes a display board 12*b* having a tic-tac-toe array 14*b* printed on the display (FIG. 3). The tic-tac-toe game 10*b* controls the electronic display of the selected "X's" 16*b* and "O's" 18*b* on display board 12*b*. A game mode select switch 30*b* enables the game 10*b* to be played in the solitary mode of operation against a microprocessor programmed to play tic-tac-toe, or in a dual mode of operation between two players. In the dual mode of operation, players may electronically select their game symbols which then appear in player displays 20*b* and 22*b*. A switch 28*b* enables the microprocessor to control the time allotted for the microprocessor to select a move in the solitary mode of operation or to limit the time the opposing player has to move in the dual mode of operation. Microprocessor accumulates the wins for each player and displays these wins in total wins displays 24*b* and 26*b***.

U.S. Pat. No. 5,248,149 relates to a method of playing tic-tac-toe using cards 1 and a playing grid 3 of at least three by three with spaces **3*a* to accommodate a card (FIG. 4). The cards have at least two different types of indicia, for example, X's 5 and O's 7**. A first player draws a card from a deck of such cards and designates the type of card drawn as his type of card. The first player then places this card in an unused space in the grid. The second player then draws a card from the deck. If it is the same type as that designated for the first player, the second player discards it such as by placing it on top of the card which has already been played. If the card selected by the second player is of a different type from that designated for the first player, the second player places it in any unused space in the grid. In a preferred embodiment, the deck also includes cards which when played on top of any other card renders the space unused. According to this game, players are permitted to place a card on the tic-tac-toe board when the indicia on the card matches each players designated indicia. Thus, there is no significant strategy added to the standard tic-tac-toe, and this game merely introduces an additional element of luck.

U.S. Pat. No. 3,770,273 describes a game of skill which in one form simulates tic-tac-toe (FIG. 5). The game includes a self-supporting frame 16c for removably lodging a plurality of indicia-bearing playing cubes 12c above a playing surface 14c. A tethered striker ball 18c is mounted above the playing surface and is adjustable in height with respect thereto for dislodging the playing cubes 12c from the frame 16c by impact-transfer between the striker ball 18c and the playing cubes 12c. Players, in turn, use the tethered ball to dislodge the playing cubes which are then reinserted into the frame, the object being the formation of a row or pattern of player-chosen indicia.

U.S. Pat. No. 5,318,307 relates to a game of skill and strategy that can be played on almost any surfaces (grass, sand, water, cement, etc.), indoors as well as outdoors (FIG. 6). This game shows some resemblance with "tic-tac-toe". The game comprises a reception frame 10d divided into nine squares 14d and four groups of disks, e.g., 22d, 24d and 26d, two for each player. The squares form targets to be hit with the disks. The first set of disks is made up of at least nine disks of the same diameter, density and thickness. The second set has only three disks of a larger diameter than those of the first group. The larger size of the disks of the second set makes them harder to lodge in the target squares. This is compensated by the fact that a larger disk can remove one of the opponent's disks and take possession of the square. First, the players take turns trying to toss the small disk into the squares. After this phase, they use the larger disks to try to dislodge the opposing player's disks and gain an advantage on him/her.

Unfortunately, all these prior art attempts at making tic-tac-toe interesting and challenging have not been successful. That is, the prior art has been unable to successfully provide a tic-tac-toe game that combines the attributes of skill, luck, and simplicity with rapid play.

Accordingly, it is desirable to provide a game that provides a player the opportunity to exercise their skill. It is also desirable to provide a game that includes luck to make the game exciting, unpredictable and enjoyable for people of all levels of intelligence.

It is further desirable to provide a game that has simple rules so that new players may learn the game easily, including learning the appropriate strategy for the game.

It is also desirable to provide a game that can be played rapidly so that multiple games can be played between two or more players in a short period of time. It is also desirable to provide a game that can be played between two players, or multiple players in a tournament or round-robin manner.

It is further desirable to provide a game that incorporates the feature of multiplying the game value to further enhances the excitement of the game. It is also desirable to provide a game that permits one player to "bluff" or present the appearance of having a particular advantage over another player.

SUMMARY OF THE INVENTION

It is a feature and advantage of the present invention to provide a game that permits a player the opportunity to exercise their skill.

It is another feature and advantage of the present invention to provide a game that includes luck to make the game exciting, unpredictable and enjoyable for people of all levels of intelligence.

It is another feature and advantage of the present invention to provide a game that has simple rules so that new players may learn the game easily, including learning the appropriate strategy for the game.

It is a further feature and advantage of the present invention to provide a game that can be played rapidly so that multiple games can be played between two or more players in a short period of time.

It is another feature and advantage of the present invention to provide a game that can be played between two players, or multiple players in a tournament or round-robin manner.

It is another feature and advantage of the present invention to provide a game that incorporates the feature of multiplying the game value to further enhances the excitement of the game.

It is another feature and advantage of the present invention to provide a game that permits one player to "bluff" or present the appearance of having a particular advantage over another player.

The present invention is based, in part, on the discovery or realization that previous attempts at improving the tic-tac-toe game have been unsuccessful due to the inability to combine the attributes of skill, luck, and simplicity with rapid play. The present invention is further based on the realization that combining the tic-tac-toe game with a numbered card competition provides these above desired attributes.

It is another feature and advantage of the present invention to provide a combination tic-tac-toe game and numbered card competition. In addition, it is also a feature and advantage of the present invention to provide numbered cards having a special or unique orientation to facilitate their use in the present invention.

To achieve the features and advantages of the present invention, a game device providing a combination tic-tac-toe game and numbered card competition is provided. The game device includes a game board divided into a plurality of zones arranged in a plurality of columns and a plurality of rows and forming a plurality of diagonals. The game device also includes first and second sets of playing pieces respectively used by first and second players. At least three of the first and second sets of the playing pieces are placed into at least three of the plurality of zones of the game board until at least three of the first playing pieces or at least three of the second playing pieces have been placed in one of the plurality of rows, one of the plurality of columns or one of the plurality of diagonals. The game device also includes first and second sets of cards, respectively distributed to the first and second players. Each of the first and second cards having respective first and second rankings associated therewith. To determine which playing piece is to be placed in one of the zones of the game board, the rankings of the first and second cards are compared to each other. The game device can be used in ordinary play, tournament play or chouette play. In addition, the game device includes the features of doubling, bluffing and variations.

In another embodiment of the invention, a method of playing a game includes the steps of uncovering, by each of the first and second players, respective first and second cards from the first and second sets of cards respectively, and comparing the first and second rankings of the first and second cards and determining whether the first or second playing piece is to be placed in one of the plurality of zones of the game board responsive thereto. The method also includes the steps of placing one of the first and second playing pieces in any of the plurality of the zones of the game board that do not already include one of the game pieces responsive to the comparing step and game strategy, and repeating the uncovering step, the comparing step, and the placing step until at least three of the first playing pieces or at least three of the second playing pieces have been placed in one of the plurality of rows, one of the plurality of columns or one of the plurality of diagonals.

BEST MODE FOR CARRYING OUT THE INVENTION

The following describes the basic components and rules for playing the combination tic-tac-toe and numbered card game.

General Scoring Rules

There are three methods of scoring used in the combination tic-tac-toe game and numbered card combination:

(1) Each game is worth 1 point (Simplest)

In this method, the first player to reach an agreed upon point total wins. Ties and doubles are not used.

(2) Game value is one plus the number of ties (Harder)

In this method, the first player to reach an agreed upon point total wins. Ties effect the Game Value (add 1 for each tie). Doubles are not used.

(3) Game Value calculated from ties and doubles (Hardest)

In this method, the first player to reach an agreed upon point total wins. Ties effect the Game Value (multiply current Game Value by two each time the game is doubled).

Number of Players

The combination tic-tac-toe game is commonly played with 2 players, but can also be played with 3 or more players (see Chouette Rules below). One player uses the "X"s, and the other uses the "O"s.

Equipment

Figure 1:
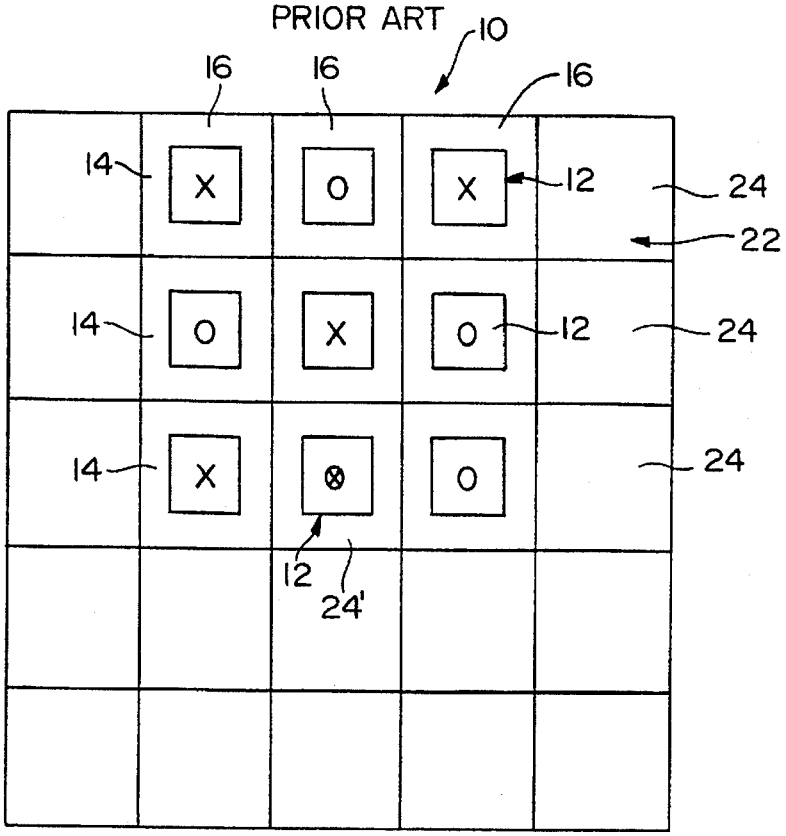
FIG. 1 PRIOR ART
FIG. 1 is an illustration of a first prior art tic-tac-toe game.
Figure 3:
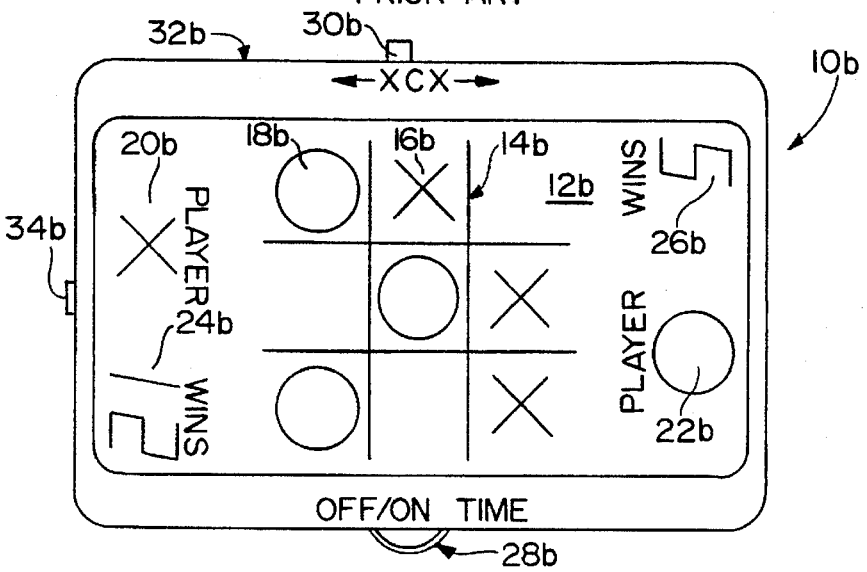
FIG. 3 PRIOR ART
FIG. 3 is an illustration of a third prior art tic-tac-toe game.
Figure 2:
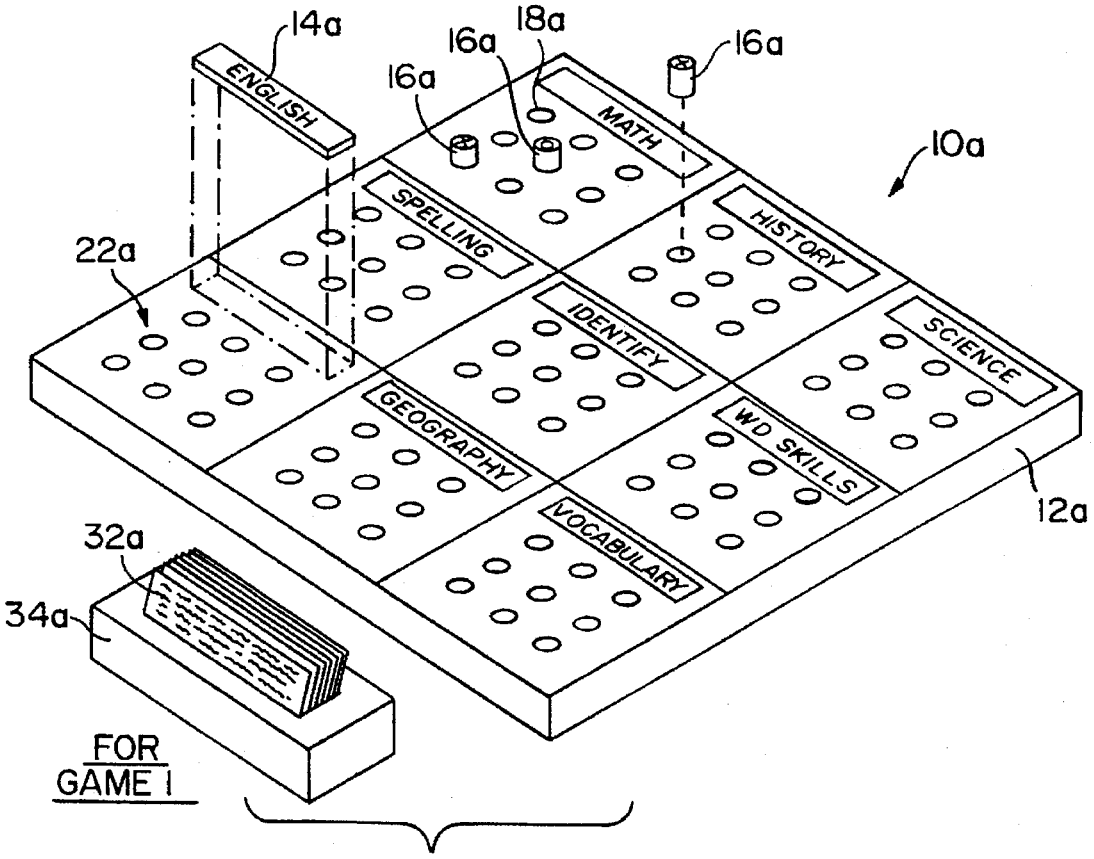
FIG. 2 PRIOR ART
FIG. 2 is an illustration of a second prior art tic-tac-toe game.
Figure 4:
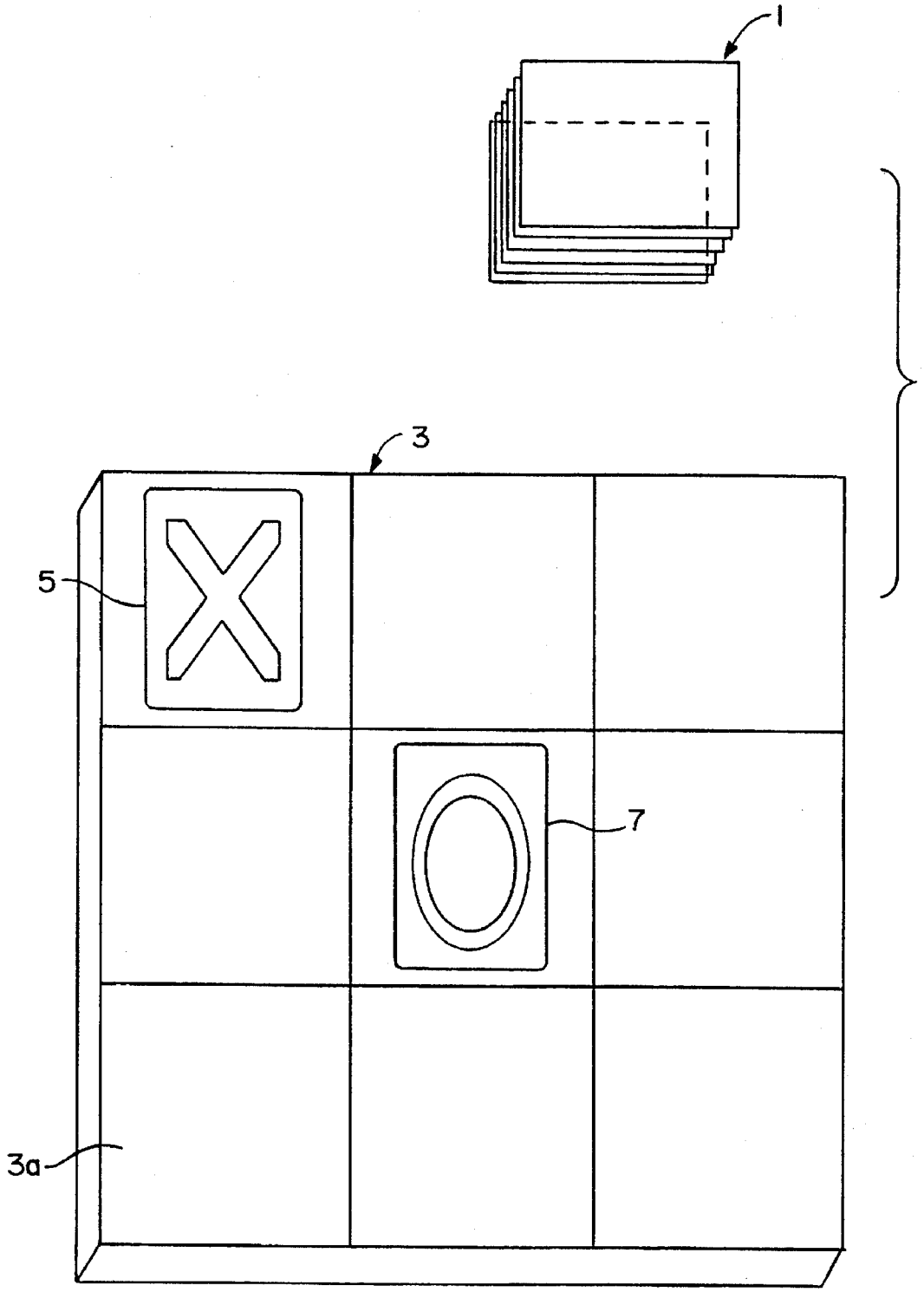
FIG. 4 PRIOR ART
FIG. 4 is an illustration of a fourth prior art tic-tac-toe game.
Figure 5:
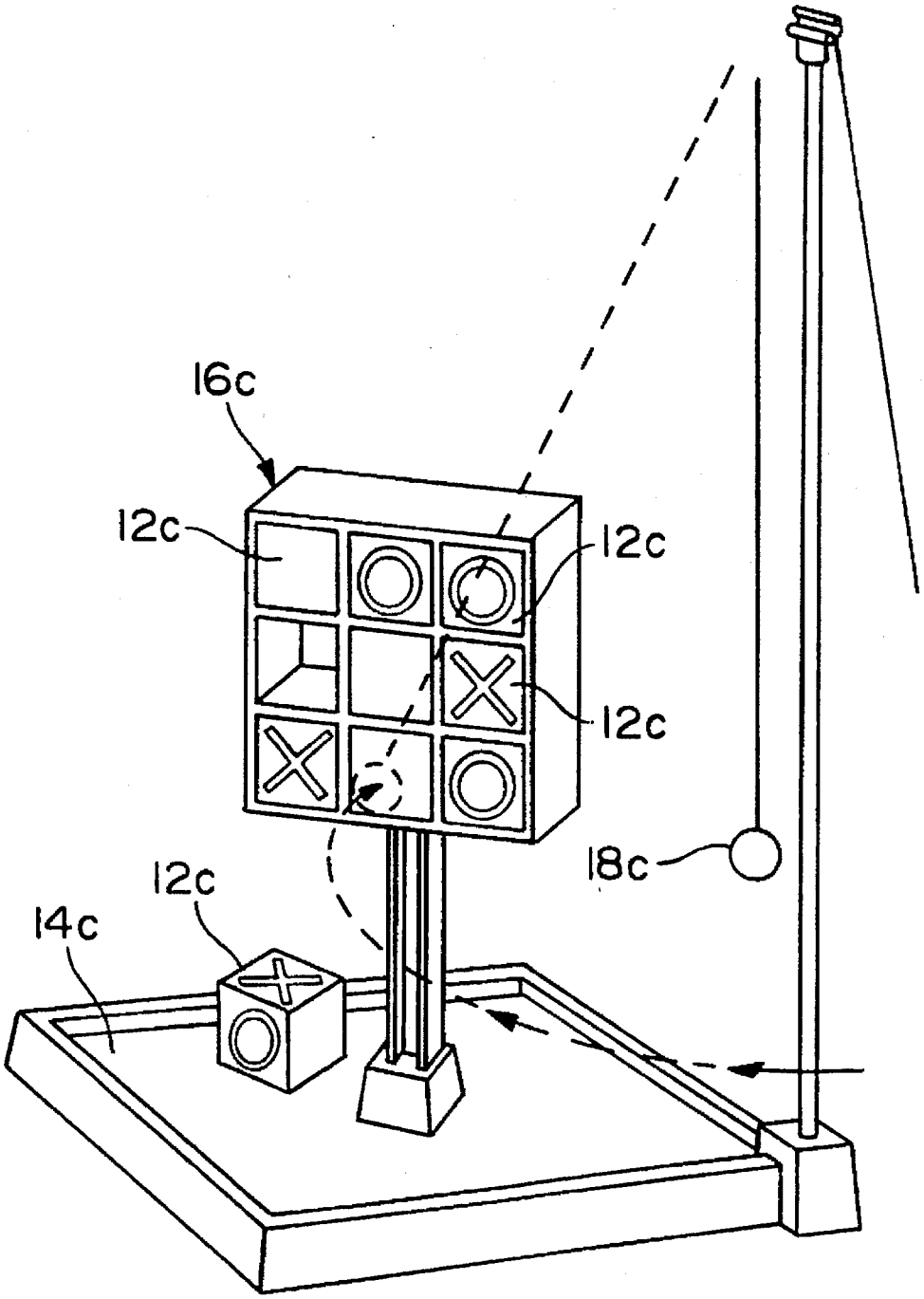
FIG. 5 PRIOR ART
FIG. 5 is an illustration of a fifth prior art tic-tac-toe game.
Figure 6:
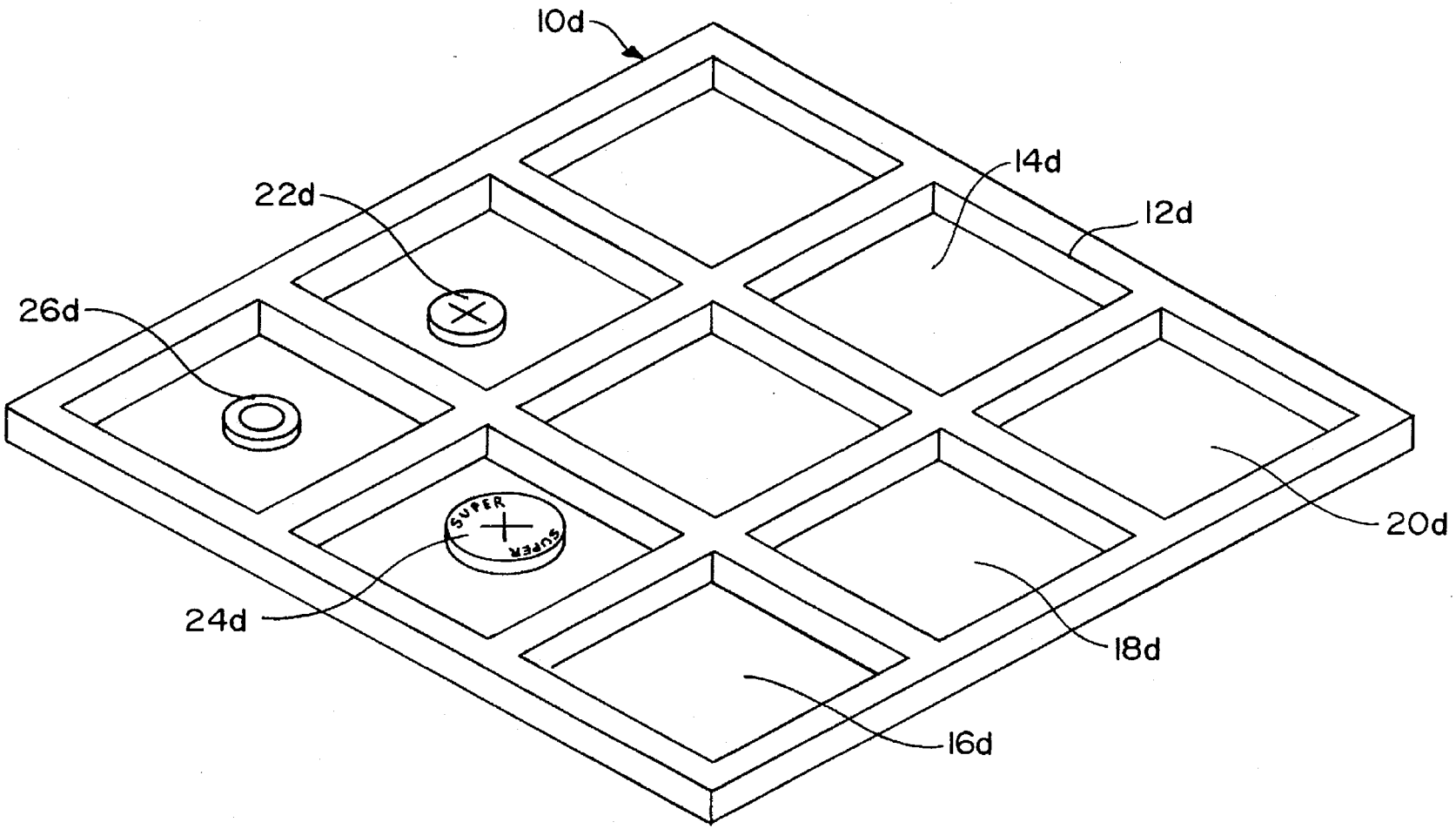
FIG. 6 PRIOR ART
FIG. 6 is an illustration of a sixth prior art tic-tac-toe game.
Figure 7:
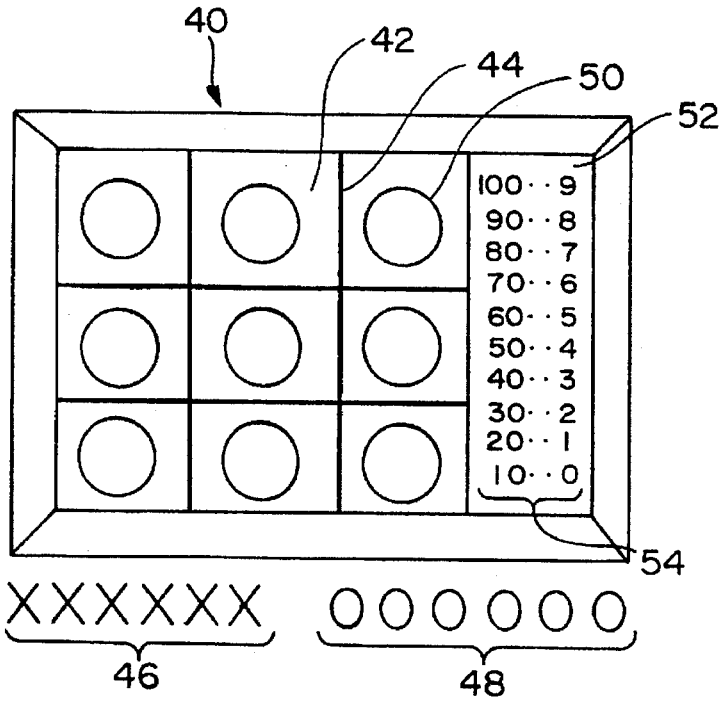
FIG. 7 is an illustration of the game board in the tic-tac-toe and numbered card combination game.

The game equipment consists of the following items illustrated in FIGS. 7–11:

(1) A game board 40 with a flat surface 42 and a grid 44 superimposed on it (FIG. 7).

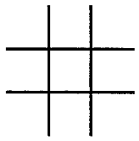

The game board 40 preferably includes nine holes or depressions 50 filled with green felt (FIG. 7).

(2) Two sets of "X"s 46 and "O"s 48, six of each (FIG. 7).

(3) A counter 52 capable of displaying any number from 1 to 99. Counter 52 preferably includes two vertical columns 54 of holes for insertion with pegs (FIG. 7).

Figure 8:
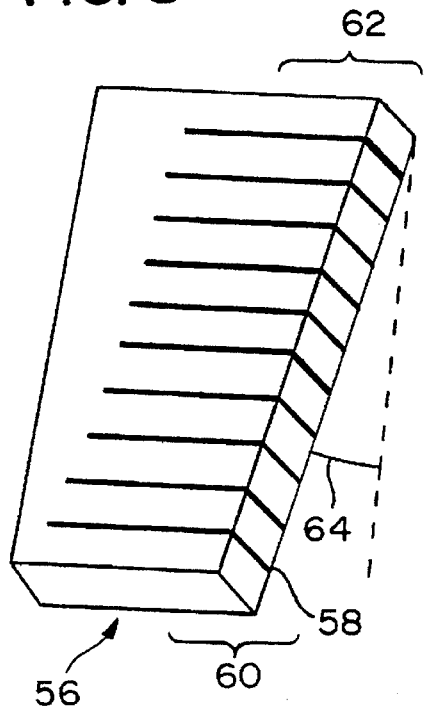
FIG. 8 is an illustration of the numbered card holder in the tic-tac-toe and numbered card combination game.

(4) Two card racks 56, each capable of holding all nine cards of a set (FIG. 8). Card rack 56 includes ten slits 58, each wide enough for a playing card to be easily inserted therein. The length of each slit is preferably the same, and sufficiently shallow to permit the playing card to be exposed outside the slit 58 approximately ¾". Therefore, for a 3" card, each of the slits 58 are approximately 2¼" deep. Card holder 56 is designed so that the front end portion 60 is preferably narrower than the rear portion 62, thereby further enhancing the readability of the playing cards inserted therein, particularly in view of the fact that slits 58 are of substantially the same length. In other words, angle 64 is formed which indicates the relative difference in widths between the front portion 60 and rear portion 62 of card holder 56.

Figure 9:
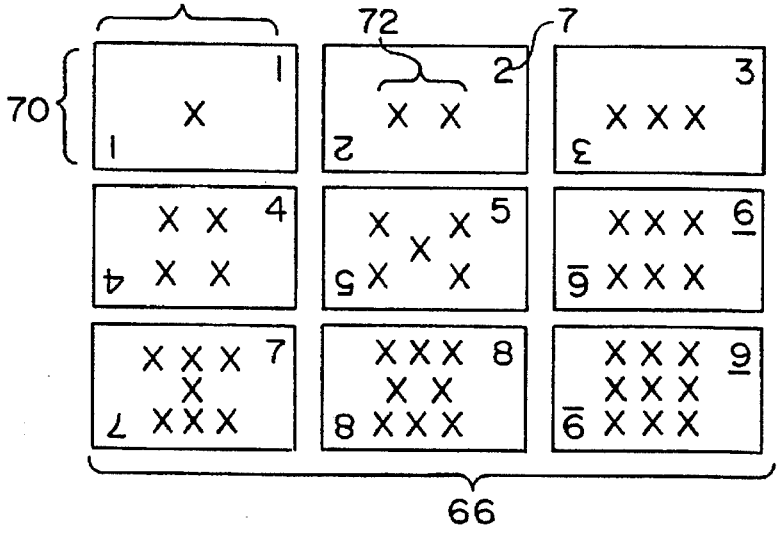
FIG. 9 is an illustration of the numbered cards used in the tic-tac-toe and numbered card combination game.

(5) Two sets of numbered cards 66 (See FIG. 9 illustrating one set of cards).

(6) Each set 66 contains cards with the numbers 1 through 9. Each set is also identified by either having an X or an O printed thereon 72, corresponding to the number 74 printed on each card. Advantageously, the card is oriented and configured in a manner to facilitate play of the tic-tac-toe and numbered card competition. As illustrated in FIG. 9, the horizontal orientation 68 is the longer side than vertical orientation 70. This configuration greatly facilitates play of the tic-tac-toe numbered card competition since the cards 66 are placed in card holder 56 in the horizontal direction to permit the player to easily view all cards 66 that are placed in card holder 56.

Figure 10:
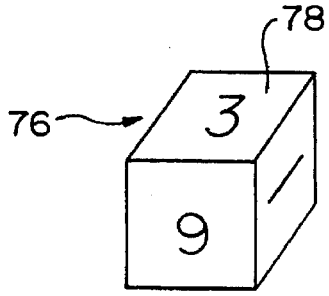
FIGS. 10 and 11 are illustrations of the game value multiply device in the tic-tac-toe and numbered card combination game.

(7) A variant die 76 with its sides 78 numbered: 1, 1, 3, 3, 9, 9 (FIG. 10). Variant die 76 is illustrated with six sides, however, other types of dies may also be used. Alternatively, the variant dies includes its sides numbered 1, 1+, 3, 3, 9, 9 or even 1+, 1+, 3, 3, 9, 9, and the like. Thus, there are several combinations of indicia that may be printed on variant die 76 to enhance the combination tic-tac-toe and numbered card.

Figure 11:
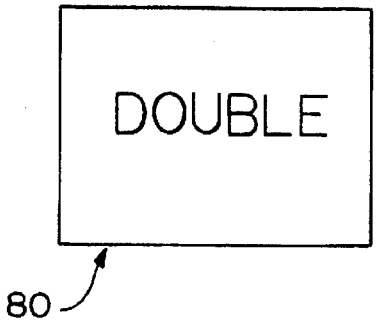

(8) A card 80 with the word DOUBLE on it (FIG. 11).

Object of the Game

The object of combination tic-tac-toe and numbered card game is to place 3 tokens 46, 48 on the tic-tac-toe board.

In a row,

In a column, or

On a diagonal.

Game Variations

There are 4 common tic-tac-toe variations in accordance with the present invention:

Variant 9,

Variant 3,

Variant 1, and

Variant 1+1.

The Variant Die 76 is used to randomly select your game variations. These different variations are described in detail below.

How to Play—General Rules For All Game Variations

The game starts with the tic-tac-toe board 40 cleared of all tokens ("X"s 46 and "O"s 48) and the Game Value 54 set at 1. Each player starts with 9 cards 66 numbered 1 through 9. According to the variation you are playing (described below), arrange your cards in the order you wish to play them. The double card 80 starts in the middle, near the game board 40. No modifications to the playing order may be made after the first card is compared.

Starting from the front of the rack 56, players expose and compare one card at a time. The player who has the higher numbered card, places a token (i.e., an X or O) on any unoccupied space 50 on the tic-tac-toe board 40. The game continues in this fashion until one player gets three tokens in a row, column or diagonal.

The play begins with a move. Each player plays the frontmost card in the rack 56 by placing it face up for viewing by other players. Whichever player reveals the higher numbered card gets to place their X or O on the playing surface, in any of the nine grid positions 50. The moves continue, in the same fashion, revealing the next card, and whichever player reveals the higher numbered card for each round gets to place his X or O on the playing surface. The game ends when one player (the winner) has placed three of his "X"s or "O"s in a row or column or diagonal—or—if it is not possible for either player to create a row or column or diagonal of just "X"s or "O"s (a draw).

If all nine cards 66 have been revealed and because of ties there are still open grid locations to place "X"s and "O"s, then the players will alternate placing their "X"s or "O"s without the use of cards resulting in a winner or a draw. The player who did not move last will place his X or O first. The winner gets the points shown by the counter 54 and the counter 54 is reset to one for the next game. After a draw, the counter 54 is not reset, and the next game is played for a higher value.

If the Cards are Equal (A Tie)

There are various options available when the numbered cards are equal resulting in a tie:

(1) Neither player places a token X or O 46, 48 on the board 40, or (2) Alternate between players to place a token 46, 48 on the board 40 as each tie occurs.

Additionally, the game value may also optionally be increased one or more points. When a tie occurs, the game value can be incremented using the game value pegs used by counter 54. For ties relating to when all nine cards have been played and neither player has won, see below discussion relating to winning the game.

Strategy

There are various levels of strategy for this game. Some of the more important strategies are described below:

(1) Arranging the numbered cards

Generally, any card arrangement can be countered or beaten by another card strategy. For example, 9 8 7 6 5 4 3 2 1—The "SLIDE" is beaten by . . .

1 2 9 8 7 6 5 4 3—The "BUNGEE PLUNGE" which loses to . . .

6 5 4 9 8 7 3 2 1—The "TRIPLE DIP" which loses to "SLIDE."

Thus, there are various combinations of cards that can be played, depending on the personality, aggressiveness and strategy of each player.

(2) The placing of "X"s and "O"s

Here the strategies of tic-tac-toe are generally applicable, but not completely, as will be discussed below.

(3) Going for the Win

Knowledge of numbered cards played can sway the normal strategies of tic-tac-toe. For example,

| | | |
|---|---|---|
| X | O | |
| X | | |
| | | |

If player O wins the next move he would normally block Player X. However, with the knowledge of which numbered cards have been used, he may elect to play for the WIN! By not blocking Player X, Player O hopes or bets that she will also win the next move to create the winning position:

| | | |
|---|---|---|
| X | O | |
| X | O | |
| | O | |

(4) Doubling

Doubling can be used to assure victory or to bluff and create a victory from a potential loss.

For example, if after two moves, Player X has revealed 9 8, while Player O has revealed 1 2, the game board looks like this:

| | | |
|---|---|---|
| X | | |
| | X | |
| | | |

It appears that Player X is headed to an easy victory but, lo and behold, Player O reaches for the double card. Player X must now guess whether his card combination, for example, of the "SLIDE"—9 8 7 6 5 4 3 2 1 has met Player O's card combination of the deadly BUNGEE PLUNGE 1 2 9 8 7 6 5 4 3 or is Player O's doubling just a BLUFF? Perhaps Player O really has a losing order 1 2 6 7 8 9 5 4 3! Can Player X "take the double"? He very well might, if Player X has the combination 9 8 1 2 7 6 5 4 3. If Player X has the favorable hand of 1 2 9 8 7 6 5 4 3, he will probably accept the double.

Playing With More Than 2 Players (Chouette)

Whoever cuts the high card or rolls the high dice is placed in the "box" and plays alone against a team composed of everyone else. Second-high cut or roll is captain of the team and makes all the plays in consultation with his/her teammates. Order of succession to the captaincy in succeeding games is determined by the initial cut or roll, with the lowest becoming the foot, and last to run the team.

The Captain has final say on all plays except responses to doubling. When a double is offered by either side, any member of the team may choose to resign, "paying" the game value to the man in the box. When the person in the box refuses a double or is beaten, he/she "pays" the full game value to each member of the opposing team and then becomes the foot. The captain is now in the box and the second ranking member of the team becomes the captain.

The Variant Die

Players will find the game variants require different strategies and each holds its own fascination. The variant die is cast before each game to determine which variant will be played.

Variant 9

Each player places all 9 cards in a rack, in the order they wish to play them. This is the standard way of playing the tic-tac-toe game of the present invention. Follow the instructions for play outlined above.

Variant 3

Each player places 3 of their nine cards in a rack, in the order they wish to play them (leaving the remaining 6 cards face down).

After all 3 cards have been compared, each player chooses 3 more cards from the 6 remaining cards and places them in the rack in the order they wish to play them.

After these cards have been compared, each player places the final 3 cards in the rack, in the order they wish to play them.

Variant 1

No cards are placed in the rack, instead they are all held in the player's hand and played one at a time. That is, the player has the chance to change his strategy before every card that he plays.

Variant 1+1

Each player places 2 of their 9 cards in a rack, in the order they wish to play them. Leaving the remaining 7 cards face down. Starting from the front of the rack, players expose and compare the front card only. Do not expose the second card. The player who has played the higher numbered card, places a token on any unoccupied space on the board.

Each player then chooses 1 card from the remaining cards and places it in the rack behind the card that is already there. Again, players expose and compare the front card only. Again, the player who has played the higher numbered card, places a token on any unoccupied space on the board. Again, each player chooses 1 card from the remaining cards and places it in the rack behind the card that is already there.

Repeat the last three steps until one player gets three tokens in a row, column or diagonal.

During the First 9 Cards

A player wins during the first 9 cards if:

He places 3 tokens in a row, column or diagonal, or

He doubles, and his opponent rejects the double.

After 9 Cards Have Been Played

If all 9 cards have been played and no one has won the game play continues as follows: The player who lost the last play, places a token on the board. Players then alternate placing a token until one player wins, or, 9 tokens have been played and there is still no winner.

After Nine Moves, A Player Wins

After nine moves, a player wins by having placed more tokens, or if both players have placed the same number of tokens, by having placed the last token. The winning player (or survivor) collects the game value.

Alternatively, a new game can be started. The starting game value of the new game is, equal to the ending game value of the previous (no winner) game.

Game Value

Each game generally starts with a game value of 1. Each tie increases the game value by 1 (optional). Doubles, multiply current game value by 2. The winner of the game receives the game value.

Double Tile & Bluffing (Optional)

A player may double the game value by "giving" the double tile to his opponent. At the start of the game, the double tile is held by neither player. The first double may be given by either player, at any time. The player who doubles gives the double tile to his opponent. After the first double, only the player who holds the double tile may double. Therefore, no player may double two times in a row.

Accepting or Rejecting the Double

After one player doubles, the other player has the option to accept or reject the double. If the double is accepted, then the game value is doubled and the scoring peg is moved to the appropriate value. If the double is rejected, then the game ends with the game value unchanged and the player who doubled wins.

Bluffing

The Double tile introduces the possibility of bluffing. For example, if player X can win on the next move and his 9 is unplayed, while player O has used his 9—player X has a classic doubling situation. Player X's next card could be a 1, but player O is likely to be bluffed out since player O knows that player X has a higher card than any of his cards.

If player X doubles in this situation with a low-numbered card coming up next, player X is making a bluff. If player X doubled with a 9 next, player X is assured a victory. But the player being doubled does not know whether it is a bluff or a guaranteed win until after the player accepts or rejects the double and the next card is played.

Doubling

All doubles multiply the game value by 2. The game value starts at twice the game bet and is doubled by each double. The player may not double two times consecutively. Once a player has doubled, he must wait for his opponent to double before doubling again.

EXAMPLES a) The counter is at 1.

1. Player X doubles and Player O rejects, X wins 1 point.
2. Player X doubles and Player O accepts, then the eventual winner must get at least 2 points.

b) The counter is at 3.

1. Player X doubles and Player O rejects, X wins 3 points.
2. Player X doubles and Player O accepts, then the eventual winner must get at least 6 points.

Prizes

The chart below demonstrates sample jackpot, payoffs for tournaments of 8, 16, 32, 64, 128, 256, 512, 1024 and 2048 players.

JB=Jackpot Bet.

| # of Players | Rounds of Play | 1st Place Payoff | 2nd Place Payoff |
|---|---|---|---|
| 8 | 3 | 6*JB | 1*JB |
| 16 | 4 | 12*JB | 2*JB |
| 32 | 5 | 24*JB | 4*JB |
| 64 | 6 | 48*JB | 8*JB |
| 128 | 7 | 96*JB | 16*JB |
| 250 | 8 | 192*JB | 32*JB |
| 512 | 9 | 384*JB | 64*JB |
| 1024 | 10 | 768*JB | 128*JB |
| 2048 | 11 | 1536*JB | 256*JB |

So, for example, if there is a tournament of 512 players, and the Jackpot Bet=$10, the tournament winner would win $3,840, the second place finisher would win $640, and the remaining $640 would go to the game organizer for expenses associated with the tournament. Other variations of tournament jackpot may also be used, and are considered within the scope of the present invention.

The Tournament

The tic-tac-toe and numbered card combination tournament is similar in structure to a tennis tournament. Each tournament starts with a field of 8 to 2048 players. Opponents play one-on-one games of tic-tac-toe. The winner of the game advances to the next round of play, and plays another game against a new opponent. The field is cut in half each round until two players remain for the finals. The winner and second place finisher divide the tournament jackpot (see previous discussion relating to tournament payoffs).

To enter a tournament, players choose a jackpot bet amount (in player setup). Players who choose the same jackpot bet amount are grouped together in a knockout tournament.

In Each Tournament Round

Players are paired off. Each pair makes a game bet and plays a game of tic-tac-toe. The winner of each game wins the game value (see doubling and game payoffs). The winner advances to the next round of the tournament.

Player With The Higher Number

The player with the higher number can double (if possible). Then the player with the higher number place a token. Next, the player can accept or reject a double from other players (if given).

Player With The Lower Number

The player with the lower number can accept or reject a double (if given) by another player, such as the player with the higher number. The player with the lower number can double the bet for other players (if possible).

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. For example, instead of using numbered cards, other methods may be used to perform a similar function, such as colors wherein different colors have different values/priorities. Similarly, the cards may include pictures that signify their value.

For example, it is commonly known that an ace card is of a higher value that a king card, and that a king card is of a higher value than a queen card, and the like. The present invention encompasses such a priority scheme and other priority schemes used to signify card value, worth or priority.

What is claimed is:

1. A game device, comprising:

a game board divided into a plurality of zones arranged in a plurality of columns and a plurality of rows and forming a plurality of diagonals;

first and second sets of playing pieces respectively used by first and second players, at least three of the first and second sets of the playing pieces being placed into at least three of the plurality of zones of said game board until at least three of the first playing pieces or at least three of the second playing pieces have been placed in one of the plurality of rows, one of the plurality of columns or one of the plurality of diagonals;

first and second sets of cards, respectively distributed to the first and second players, each said first and second cards having respective first and second rankings associated therewith, the first and second rankings providing respective first and second priorities for all the cards with respect to each other in each of the first and second sets of cards respectively, wherein to determine whether the first or second playing piece is to be placed in one of the plurality of zones of said game board, each of the first and second players uncovers respective first and second cards from the first and second sets of cards respectively, and the first or second playing piece is placed in any of the plurality of the zones of said game board that do not already include one of the game pieces responsive to a comparison between the first and second cards and the ranking associated therewith and also responsive to game strategy.

2. A game device according to claim 1, wherein the comparison between the first and second cards and the ranking associated therewith used to determine which of the first or second playing pieces is to be placed next on the game board comprises the one of the first and second cards assigned a first priority higher than a second priority of another of the first and second cards.

3. A game device according to claim 2, wherein each of the first and second sets of cards are numbered, and wherein the comparison includes comparing a first number having the first priority on the first card with a second number having the second priority on the second card.

4. A game device according to claim 3, wherein each of the first and second cards are of a rectangular shape having a first side of shorter length than a second side, and wherein numbers are printed on the first and second cards in parallel with the second side of the first and second cards for reading by the first and second players.

5. A game device according to claim 1, further comprising first and second card holders having slots for placement of the first and second sets of cards respectively, each said first and second card holders is tapered, wherein each of the first and second cards are of a rectangular shape having a first side of shorter length than a second side, wherein numbers are printed on the first and second cards in parallel with the second side of the first and second cards for reading by the first and second players, and wherein the tapering of the first and second card holders facilitates reading of the numbers on the second side of each of the first and second cards.

6. A game device according to claim 1, further comprising a game variant selection device for selecting between different variants of playing said game device, wherein said game variant selection device prescribes a subset of cards in each of the first and second sets of cards that are to be arranged in respective first and second orders by the first and second players respectively that are to be played at a time, and wherein when the subset of cards have been played by the first and second players, the first and second players arrange a second subset of cards using the cards remaining in the first and second sets of cards to be played next.

7. A game device according to claim 6, wherein the game variant selection device selects between variant all, variant 3, and variant 1, wherein for the variant all each player places all the cards in a first order that must be maintained for the entire duration of the game until completion, wherein for the variant 3 each player places three cards in a second order that must be maintained for the duration of play of the three cards, and after the three cards have been played, each player selects another three cards in a third order that must be maintained for the duration of play of the another three cards, wherein for the variant 1 each player plays each of the cards in the first and second sets of cards one at a time.

8. A game device according to claim 6, wherein the game variant selection device selects a variant 1+1, wherein for the variant 1+1 each player places two cards in a first order for play leaving the remaining cards covered, and each player exposes one of the two cards for play, and after the one of the two cards has been played, each player selects a third card from the remaining cards and exposes another of the two cards for play.

9. A game device according to claim 1, further comprising a doubling device for doubling a game value assigned for winning a game using the game device, wherein when one of the players doubles the game value using the game device, another of the players has the option of accepting or rejecting the double, wherein when the double is accepted, the game value is doubled, and when the double is rejected, then the game ends with the game value unchanged and the one of the players wins the game.

10. A game device according to claim 9, wherein the doubling device introduces the ability for the players to bluff one another.

11. A game device according to claim 1, wherein the game device is used in a tournament, wherein in the tournament, players are paired off to play a game using the game device, a winner of the game advances to a next round of play, and plays another game against another winner of a previous game until only one player remains.

12. A game device according to claim 1, wherein the game device is used in a chouette competition.

* * * * *